United States Patent [19]

Kleber et al.

[11] 4,257,769

[45] Mar. 24, 1981

[54] USE OF QUATERNARY ETHER AMINES AS FIBER PROCESSING AGENTS

[75] Inventors: Rolf Kleber, Neu-Isenburg; Hans L. Panke, Hofheim am Taunus; Erich Hoffmann, Kriftel, all of Fed. Rep. of Germany

[73] Assignee: Hoechst Aktiengesellschaft, Fed. Rep. of Germany

[21] Appl. No.: 81,073

[22] Filed: Oct. 2, 1979

[30] Foreign Application Priority Data

Oct. 6, 1978 [DE] Fed. Rep. of Germany ..... 2843659

[51] Int. Cl.[3] ..... D06M 13/34; D06M 13/46

[52] U.S. Cl. ..... 8/188; 8/115.6; 8/127.6; 252/8.75; 252/8.8; 252/8.9

[58] Field of Search ..... 8/116 P, 188, 127.6, 8/115.6; 252/8.75, 8.8, 8.9

[56] References Cited

U.S. PATENT DOCUMENTS

| | | | |
|---|---|---|---|
| 4,104,443 | 8/1978 | Latta et al. | 428/474 |
| 4,118,324 | 10/1978 | Steckelberg et al. | 252/8.8 |
| 4,134,970 | 1/1979 | Panke et al. | 424/70 |

FOREIGN PATENT DOCUMENTS 849348 6/1977 Belgium .

*Primary Examiner*—A. Lionel Clingman

*Attorney, Agent, or Firm*—Connolly and Hutz

[57] ABSTRACT

Use of quaternary ether amines of the formula I

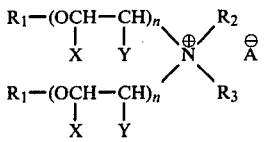

(I)

in which $R_1$ is a saturated or unsaturated alkyl radical of from 12 to 24 carbon atoms, X and Y stand for hydrogen or methyl, but do not both represent methyl at the same time, n is a number of from 1 to 5, $R_2$ and $R_3$ stand for alkyl of from 1 to 4 carbon atoms, and A is the methosulfate, chloride, or the dimetho- or triethophosphate anion, as processing agents in the preparation and processing of native and synthetic fibers.

3 Claims, No Drawings

USE OF QUATERNARY ETHER AMINES AS FIBER PROCESSING AGENTS

The present invention relates to the use of quaternary ether amines as fiber processing agents.

The use of quaternary ammonium compounds in fiber processing has been sufficiently known. The products serve in the preparation of fibers as antistatic agents with a lubricating effect. Their chemism has been described in detail in Lindner, Tenside-Textilhilfsmittel-Waschrohstoff, vol. II, pages 1616 to 1625. Besides adequate antistatic properties, quaternary ammonium compounds having long fatty acid alkyl radicals may also impart a softening effect to the fiber. A problem resides in the fact that a favorable softening effect is produced preferably by pasty "quats", whereas the liquid "quats", such as tetamethyl-ammonium methosulfate, impart a pure antistatic effect without any softening. However, in practice there is a demand—especially in fiber preparation and also in further processing in the spinning mills—for quaternary ammonium compounds with high antistatic values which show at the same time a favorable softening effect as well as a convenient handling. The desired compounds ought to be pourable substances which are easily water-soluble and do not show any thickening ("gel phases") in aqueous dilution.

It has now been found that as antistatic agents having an excellent softening effect there may be used in fiber processing quaternary ether amines of the formula I

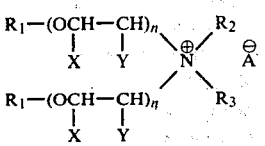

(I)

in which $R_1$ represents a saturated or unsaturated alkyl radical with from 12 to 24 carbon atoms, X and Y stand for hydrogen or methyl, but do not both represent methyl at the same time, n is a number of from 1 to 5, $R_2$ and $R_3$ stand for alkyl of from 1 to 4 carbon atoms, and A is the methl sulfate, chloride or dimetho- or triethosphosphate anion.

These compounds of the formula I are known from German Offenlegungsschrift No. 2,628,157. They are prepared by the quaternization of secondary ether amines of the formula (II)

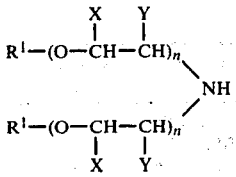

(II)

with common alkylation reagents, such as alkyl halides, alkylsulfuric acid esters or alkyl phosphates in the presence of alkali. The reaction conditions may be varied within wide limits.

The reaction is carried out preferably at an elevated temperature of from 30° to 160° C. in solvents, such as water, alcohols, for example ethanol or isopropanol, aromatic hydrocarbons, for example toluene or xylene, or in polar aprotic solvents, for example dimethylformamide, and in the presence of alkali, such as sodium hydroxide, sodium carbonate or sodium hydrogen carbonate, however, the operation may also be effected at room temperature or without solvent. In order to obtain colorless products, it is advantageous to carry out said reaction under an inert gas atmosphere, for example under a nitrogen blanket.

The secondary ether amines of the formula (II) are known for German Offenlegungsschrift No. 2,555,895. They are prepared by reacting oxalkylates of the formula III

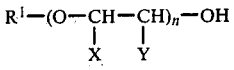

(III)

in which $R^1$, X, Y and n are defined as in formula (I), in the liquid phase with ammonia and hydrogen in the presence of hydrogenation-dehydrogenation catalysts, especially nickel and cobalt catalysts, at a gas rate of at least 10 liters/kg of oxalkylate x h at a temperature of from 150° to 250° C. and at atmospheric pressure in the range of from 0.5 to 1.5 atmospheres, and by removing the reaction water together with the gas current.

By the saturated and unsaturated alcohols which are at the basis of the oxyalkyl derivatives of the formula III and which form the radical $R^1$ in the compounds of the formula I there may be understood those which contain a primary, secondary or tertiary alcoholic group in the molecule. The alkyl radical may be straight-chained or branched and is derived from a corresponding alcohol, for example lauryl alcohol, isotridecyl alcohol, oleyl alcohol, stearyl alcohol; there may further be mentioned mixtures of these alcohols, especially those which are formed in the hydrogenation of natural fatty acids or of their esters, such as tallow oil alcohols, palm oil alcohols and coconut oil alcohols. Further alcohols, from which the radical $R^1$ may be derived, are those which are obtained in technical processes, for example the Ziegler process, which yields saturated primary alcohols with a straight carbon chain of up to about 24 carbon atoms, and the various oxo processes which produce more or less branched alcohols.

The oxalkylene group

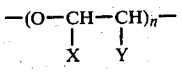

is derived preferably from ethylene oxide or propylene oxide and is introduced by reacting the above-specified alcohols with ethylene oxide and/or propylene oxide. There may also be employed mixtures of ethylene oxide and propylene oxide, or said alcohols may be reacted successively with ethylene oxide and propylene oxide.

The quaternary ether amines are easily miscible with water. They impart to the native and synthetic fibers finished with them, for example PA, PES, polyolefin, but also cellulose fibers, excellent antistatic properties besides a good softening effect and a high lubricity.

The products are applied in the fiber preparation onto filaments after spinning and onto staple fibers during spinning, drawing or prior to cutting or converting, in an amount of from 0.01 to 1, preferaby from 0.1 to 0.4%. The application may be effected by dipping, spraying, doctoring, slop-padding, or other finishing processes. The quaternary ether amines may be applied by themselves or in combination with other processing agents, such as mineral oils, ester oils, emulsifiers, such as oxethylated fatty alcohols or oxethylated nonyl phenols, agents for effecting a cohesion of the filaments, such as castor oils, silicon oils, and others.

The quaternary ether amines of the formula I may be applied as pure products with 100% of active substance, which may be advantageous, if the products are present in a liquid form. However, in most cases they are present as 20 to 30% formulations in water, which represent pourable pastes. The application as liquid formulation is then effected from aqueous solutions containing from about 5 to 150 g/l of solid substance.

The following Examples illustrate the present invention.

EXAMPLE 1

400 Parts of a secondary ether amine, molecular weight 787 with 1.78% of nitrogen showing a basic reaction, which amine has been obtained by the aminolysis of a straight-chain $C_{20/22}$-alcohol with 2 mols of ethylene oxide, are heated with 30.3 parts of sodium hydroxide and 40 parts of water in a 2 liter laboratory autoclave to a temperature of from 70 to 80° C., in which process methyl chloride is introduced up to a pressure of 5 kp/cm$^2$. When the methyl chloride is no longer absorbed by the reaction mixture, the latter is aired, and the product is filled off which has the following formula

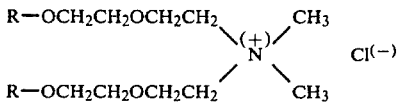

R = $C_{20}$-alkyl and $C_{22}$-alkyl.

The quaternization degree is 98%, with 2% of free amine and ammonium chloride being present. The product can be emulsified in water. Its 1% aqueous solution shows a pH of from 4 to 5.

EXAMPLE 2

200 Parts of a secondary ether amine, molecular weight 952, which has been prepared by the aminolysis of a straight-chain $C_{20/22}$-alcohol having been reacted with 1 mol each of ethylene oxide and propylene oxide, are quaternized—as it has been described in Example 1—in 100 parts of toluene, while adding 40 parts of sodium carbonate, with two times 14.5 parts each of dimethyl sulfate.

There is obtained a product of the formula

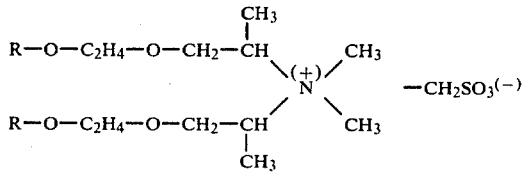

in a 99% yield. The quaternization degree is 92%.

The content of nitrogen showing a basic reaction in the starting compound was 1.47%.

EXAMPLE 3

As has been described in Example 1, 100 parts of a secondary ether amine, molecular weight 615, which is obtained by the aminolysis of a stearyl alcohol reacted with 1 mol of ethylene oxide, are quaternized in 100 parts of toluene, while adding 40 parts of sodium carbonate, with two times 27.5 parts each of diethyl sulfate.

A product is obtained in a 98% yield which does not contain any nitrogen showing a basic reaction and which corresponds to the formula

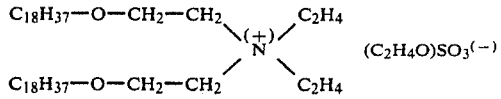

The content of nitrogen showing a basic reaction in the starting compound was 2.27%.

According to Examples 1 to 3, the following compounds were synthesized:

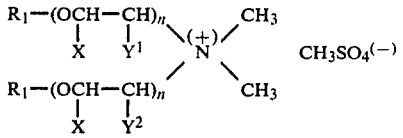

| | $R_1$ | X | $Y^1$ | $Y^2$ | n: |
|---|---|---|---|---|---|
| (4) | $C_{20/22}H_{41/45}$ | H | $CH_3$ | $CH_3$ | 4 |
| (5) | $C_{20/22}H_{41/45}$ | H | H | $CH_3$ | 2 |

EXAMPLE 5

The quats produced according to the invention in the above Examples Nos. 1 to 5 were tested by comparison with the following quats:

(6) Condensation product of 1 mol of stearic acid + 1 mol of triethylene tetramine perquaternized with dimethyl sulfate (50% paste);

(7) dodecyl-dimethyl-benzyl ammonium chloride (50% strength in isopropanol)

I. The products were applied from a 10% aqueous solution by means of a lick roller onto PA 6 filaments (dtex 220 f 40) with an amount of 0.7% of active substance and were dried at 120° C.

The filaments thus finished were tested on the one hand for their softness to the feel and on the other for their sliding friction according to German Offenlegungsschrift No. 2,416,430. The adhesive friction (static friction, filament-filament friction) was also determined (as a measure for the separating capability) (German Offenlegungsschrift No. 2,416,430).

| Compound | Sliding friction | Adhesive friction | Feel |
|---|---|---|---|
| 1 | 0.225 to 0.300 | 4 | very soft |
| 2 | 0.250 to 0.330 | 3 | soft |
| 3 | 0.220 to 0.290 | 2 | very soft |
| 4 | 0.270 to 0.350 | 4 | soft |
| 5 | 0.260 to 0.320 | 4 | soft |
| 6 (Comparison) | 0.390 to 0.510 | 6 | mashy, soft |
| 7 (Comparison) | 0.420 to 0.530 | 20 | rough, harsh |

Only the ether amine quats of the invention show both a soft feel and a low sliding and adhesive friction.

What is claimed is:

1. Process for the processing of native and synthetic fibers which comprises applying as processing agent onto the fibers a quaternary ether amine of the formula I

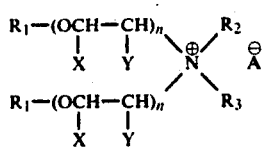

(I)

in which $R_1$ is a saturated or unsaturated alkyl radical of from 12 to 24 carbon atoms, X and Y stand for hydrogen or methyl, but do not both represent methyl at the same time, n is a number of from 1 to 5, $R_2$ and $R_3$ stand for alkyl of from 1 to 4 carbon atoms, and A is the methosulfate, chloride, or the dimetho- or triethophosphate anion.

2. Process of claim 1 wherein the amount of processing agent employed is 0.01 to 1%.

3. Process of claim 1 wherein the processing agent is employed in a pure form or from a 20 to 30% solution diluted upon application to a 5 to 150 grams per liter solids content.

* * * * *